United States Patent [19]

Lasenga

[11] Patent Number: 4,809,404

[45] Date of Patent: Mar. 7, 1989

[54] APPARATUS FOR COMPACTING A NONWOVEN FABRIC, ETC.

[75] Inventor: Werner Lasenga, Duelmen, Fed. Rep. of Germany

[73] Assignee: Hergeth Hollingsworth GmbH, Duelmen, Fed. Rep. of Germany

[21] Appl. No.: 169,689

[22] Filed: Mar. 21, 1988

[30] Foreign Application Priority Data

Mar. 28, 1987 [DE] Fed. Rep. of Germany ..... 3710407

[51] Int. Cl.[4] ..... D01G 15/46; D04H 1/44

[52] U.S. Cl. ..... 19/106 R; 19/152; 19/296

[58] Field of Search ..... 19/106 R, 150, 151, 19/152, 296, 308

[56] References Cited

U.S. PATENT DOCUMENTS

| | | | |
|---|---|---|---|
| 166,601 | 8/1875 | Furbush | 19/152 |
| 2,077,095 | 4/1937 | Cady | 19/151 X |
| 2,987,779 | 6/1961 | Kawashima | 19/106 R |
| 3,066,358 | 12/1962 | Schiess | 19/296 X |
| 4,274,178 | 6/1981 | Hotta | 19/106 R |
| 4,589,167 | 5/1986 | Bernhardt | 19/296 X |

FOREIGN PATENT DOCUMENTS

| | | | |
|---|---|---|---|
| 0204382 | 7/1959 | Austria | 19/296 |

*Primary Examiner*—Louis K. Rimrodt
*Attorney, Agent, or Firm*—Cort Flint

[57] ABSTRACT

Apparatus for compacting a nonwoven textile fabric mat is disclosed which includes an arrangement of rollers having a pair of juxtaposed rollers (2,3) and a superposed roller (4) arranged in a fiber compacting arrangement. Juxtaposed rollers (2,3) are spaced apart to define a space (9) in which central superposed roller (4) extends for compacting fibers. Perforations (5) extend through the surface of a shell (6) of each of the rollers. A first conveyor (16,19) conveys the textile fibers to the roller arrangement and a second conveyor belt (17,20) conveys the fibers away from the roller arrangement. Belts (19,20) may be perforated and surround rollers (2,3), respectively. Suction applied to the interior of the rollers assists in compacting the fibers in the mat as air is drawn through perforations (5) which are of a predetermined diameter and shape.

15 Claims, 1 Drawing Sheet

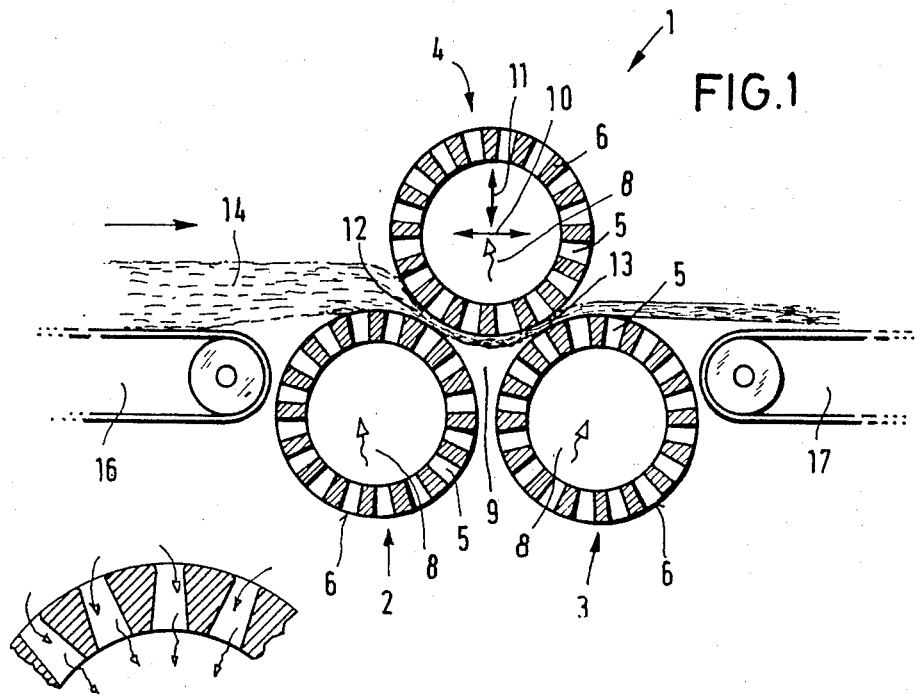
FIG.1
FIG.3
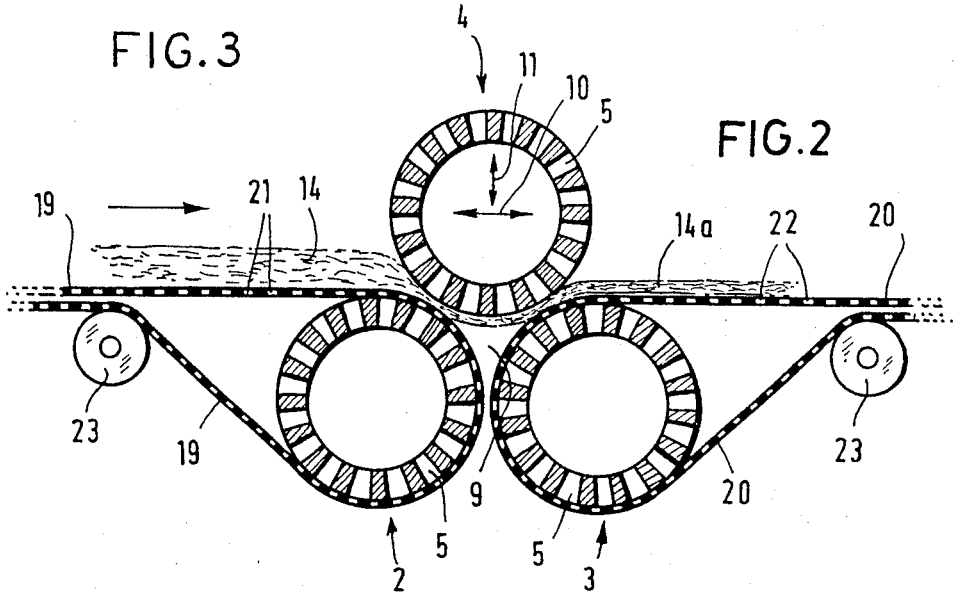
FIG.2

APPARATUS FOR COMPACTING A NONWOVEN FABRIC, ETC.

BACKGROUND OF THE INVENTION

The invention relates to an apparatus for compacting a nonwoven fabric or the like of textile fibers, e.g. of cotton, rayon staple, synthetic fibers, etc. in which the nonwoven fabric is guided under applied pressure through a gap between at least two adjacent rollers.

Calendering textile fiber mats in order to compress the mat produced by a card or the like and to impart increased fiber entanglement for better inner strength is well known. Through calendering, the portion of the nonwoven fabric having fibers in more or less loose relationship to each other is substantially reduced, while, simultaneously being compacted. As a result of calendaring, some air is pressed out of the textile fabric.

It is the object of the invention to provide an apparatus of the foregoing type in which the nonwoven textile fabric or the like is compacted reliably, intensely and easily by simple means.

SUMMARY OF THE INVENTION

The invention is characterized by several cooperating rollers, or hollow cylinders, having a perforated circumferential surface, of which one roller at least is arranged to be adjustable. By using perforated rollers for the compacting means, a number of substantial advantages may be combined. The compression of the nonwoven fabric consisting fibers loosely arranged with respect to each other, is effected most carefully and under optimum conditions. In compressing the nonwoven fabric, air may escape in various directions, namely radially into the interior of two juxtaposed, cooperating, perforating rollers, and, at the same time, although to a reduced extent, in the direction opposite to the direction of conveyance of the nonwoven fabric. Since, by the perforated rollers, the nonwoven fabric may release air between the fibers which flows radially into the rollers, the amount of air probably escaping oppositely to the conveying sense is so small that no difficulties may occur in the feeding of the nonwoven fabric into the juxtaposed rollers which are cooperating under applied pressure. The supply and transport of the nonwoven fabric are not impaired by the cooperating perforated rollers. Further, due to the careful treatment during the compression of the nonwoven fabric, a reorientation of the fibers is realized as the fabric is compacted. The fibers better adhere to each other. Bubble formation during compacting is avoided. In addition to the volume reduction, the fibers of the nonwoven fabric find by the careful pressure treatment an inner mutual support which is further intensified by the effect of the perforations of the two juxtaposed cooperating rollers. The compacting means is not limited to specific speeds of the apparatus, but it is completely effective over a wide range of speeds of the cooperating perforated rollers.

Preferably, the perforated rollers are under the action of a suction effect. The diameter of the holes of the perforated rollers is preferably in certain relationship to the thickness of the roller shell. The diameter of the holes in the roller shell shall be equal or less than the depth of the perforations. As a result thereof, air escaping through the perforations, does not also entrain fibers or short fibers. The fiber ends are more or less retained at the holes for reorientation with the other fibers of the nonwoven textile fabric during passage through the perforated rollers, resulting in a more intense mutual adherence.

According to another feature of the invention, the use of a three-roller-arrangement is provided in which the central roller extends into the interspace between the two juxtaposed perforated rollers. At the same time, the central roller is adjustable in height and in lateral direction. By this means, the effect of the clamping points between the cooperating perforated rollers is adjusted to increase for example, the gap between the two first cooperating perforated rollers and decrease the gap between the two subsequent perforated rollers. Due to such a possible adjustment of the pressure conditions, the nonwoven fabric may be guided conveniently under control and at all speeds into the compacting means.

The perforation of the rollers may be flared to the inside. The perforation edges facing the counter-roller may be sharp or round, subject to the kind of composition of the nonwoven fabric. Round edges are preferable to ensure that the fibers do not adhere to the perforations.

The supply and discharge of the nonwoven fabric to the compacting means and away from there is suitably ensured by conveyor belts conducted as closely as possible to the perforated rollers. In order to completely exclude an interruption of the transport of the nonwoven fabric, the conveyor belts may be also conducted around the perforated rollers and should also be provided with perforations. It is not necessary for the perforations of the conveyor belts and of the appertaining perforated rollers to coincide, but said perforations may be optionally positioned with respect to each other. A coincidence of the perforations of both assemblies is automatically achieved to a predominant extent.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a schematic plan view of an embodiment of the compacting means of the invention; and FIG. 2 is a modified embodiment of the compacting means of FIG. 1.

FIG. 3 is an enlarged sectional view illustrating tapered perforations in the shell of the roll according to the invention.

DESCRIPTION OF A PREFERRED EMBODIMENT

The apparatus 1 for compacting nonwoven textile fabrics, e.g. of cotton or the like comprises an assembly of three perforated rollers 2,3,4 in mutual functional connection. The circumferential surface of the perforated rollers is continuously provided with perforations 5. The rollers are hollow and having a shell 6 of a predetermined thickness. The diameter of the peforations shall be equal to, at most, but preferably less than the thickness of the cylinder shell. The interior of each roller 2,3,4 commuicates with a suction means, e.g. the sucking side of a blower, such as symbolized by arrows 8. All of the perforated rollers may be connected to a common suction source.

The mutual arrangement of the perforated rollers may be adjustable. Generally, adjustability of the preforated roller 4 mounted above the perforated rollers 2 and 3 and extending into the interspace 9 between the latter will do. Adjustment of roller 4 may be effected laterally and/or vertically. This is symbolized by arrows 10 and 11. By this means, the pressure conditions between the central roller 4 and the two lower juxtaposed roller 2 and 3 may be varied. The initial gap 12 for the introduction of the nonwoven fabric 14 to be compacted may be larger than the subsequent gap 13 between rollers 3 and 4. Thus, in case of the arrangement of FIG. 1, there are two clamping zones in a relatively close succession. The nonwoven fabric 14 is subjected to a double blow during the compacting operation.

By the predetermined size of the perforation, a careful escape of the air from the nonwoven fabric is realized, the latter not being retained prior to the entry to the first clamping point of the compacting means. The feeding of the nonwoven fabric is not affected. With the careful escape of air from the supplied nonwoven fabric, the fibrous structure is simultaneously compacted. Only the fiber ends rest in the peforations and are somewhat bent this way with a resultant improved inner mutual support. The perforation edges situated at the circumferential surface of the perforated rollers are suitably chamfered or rounded, to thus prevent the fibers from being absorbed with the air entering the roller inside. To exclude an entrainment of the fibers through the perforations into the roller inside, said perforations may be flared to the inside. As a result, the air draught is reduced and the fibers of the nonwoven fabric are left at the circumferential surface of the rollers to be further conveyed by the rotating rollers.

The loose nonwoven fabric 14 which may be discharged from a card or the like is fed to the first perforated roller by a first conveyor belt 16. The discharge from compacting means 1 may be ensured by a second conveyor belt 17.

To exclude an interruption between the first and second conveyor belts 16 and 17 and the appertaining rollers 2 and 3, care may be taken that the conveyor belts for feeding and discharging the nonwoven fabric to the compacting means and away therefrom directly engage the perforated rollers 2 and 3. In such a case, the belts are also provided with perforations 21 and 33. In a alternative embodiment, a first and second screen belt may be used in lieu of a first and second perforated conveyor belt for the transport to further contribute to the continuous and careful compacting of the fiber mat or fabric web. Reference numeral 23 designates guide rollers. The compacted nonwoven fabric 14a does not only display a substantial reduction in volume but also a more intense mutual adherence of the fibers without a resultant smoothening.

While a preferred embodiment of the invention has been described using specific terms, such description is for illustrative purposes only, and it is to be understood that changes and variations may be made without departing from the spirit or scope of the following claims.

What is claimed is:

1. An apparatus for compacting a nonwoven fabric of fibers comprising:

a plurality of juxtaposed cooperating rollers each of said rollers having a circumferential surface having a thickness and a hollow roller interior;

a plurality of perforations extending through said surface of each of said rollers having an inside edge terminating adjacent said roller interior and an outside edge opposite the inside edge;

conveyor means for delivering said nonwoven fabric under applied pressure between said rollers; and adjusting means for adjusting the relative position of at least one of said rollers.

2. The apparatus of claim 1 further comprising a suction means for drawing air through said perforations.

3. The apparatus of claim 2 wherein said perforations are flared toward said inside edges.

4. The apparatus of claim 1 including:

a series of three of said rollers having two outer rollers spaced apart from each other to define a space between said rollers, and a third central superposed roller extending within said space for compacting said fabric; and said adjusting means operating on said central roller to move said central roller vertically and in the direction in which said nonwoven fabric is delivered.

5. The apparatus of claim 1 wherein said perforations are flared toward said inside edges.

6. The apparatus of claim 1 wherein the diameter of said perforations in less than or equal to the thickness of said circumferential surface.

7. The apparatus of claim 1 wherein both said inside edges and said outside edges of said perforations are rounded.

8. The apparatus of claim 1 wherein said conveyor means comprises:

a first conveyor belt for feeding said nonwoven fabric to said rollers; and a second conveyor belt for discharging said nonwoven fabric from said rollers.

9. The apparatus of claim 8 wherein said first conveyor belt delivers the nonwoven fabric around at least a first roller of said plurality of rollers and said second conveyor belts delivers the nonwoven fabric around at least a second roller of said plurality of rollers, and said first and second conveyor belts contain a plurality of perforations.

10. The apparatus of claim 8 wherein said first conveyor belt and said second conveyor belt are screen belts.

11. An apparatus for compacting a nonwoven textile fiber mat comprising:

a plurality of rollers having a circumferential surface with a prescribed thickness;

said plurality of rollers being arranged in a series of three of said rollers consisting of a central superposed roller and two outer spaced apart juxtaposed rollers below said superposed roller defining a space in which said central roller extends for compacting said textile mat;

a plurality of perforations extending through said surface of each of said rollers having an inside edge within said roller interior and an outside edge opposite said inside edge;

conveyor means for conveying said nonwoven fabric under applied pressure between said rollers; and adjusting means for adjusting the relative position of at least one of said rollers in a vertical and horizontal direction.

12. The apparatus of claim 11 wherein said conveyor means includes:

a first perforated conveyor belt for feeding said nonwoven fabric mat to said rollers; and a second perforated conveyor belt for discharging said nonwoven fabric mat from said rollers.

13. The apparatus of claim 12 wherein said first conveyor belt travels around at least a first roller of said juxtaposed rollers and said second conveyor belt travels around at least a second of said rollers of said juxtaposed rollers.

14. The apparatus of claim 11 wherein said perforations in said roller surface are flared toward said inside edges of said surfaces.

15. The apparatus of claim 11 wherein the diameter of said perforations is less than or equal to said prescribed thickness of said roller surface.

* * * * *